US011387600B2

(12) United States Patent
Dobler

(10) Patent No.: US 11,387,600 B2
(45) Date of Patent: Jul. 12, 2022

(54) PLUG PART OF A PLUG-IN CONNECTION

(71) Applicant: Neutrik AG, Schaan (LI)

(72) Inventor: Oliver Dobler, Tschagguns (AT)

(73) Assignee: NEUTRIK AG, Schaan (LI)

( * ) Notice: Subject to any disclaimer, the term of this patent is extended or adjusted under 35 U.S.C. 154(b) by 27 days.

(21) Appl. No.: 17/048,225

(22) PCT Filed: Apr. 11, 2019

(86) PCT No.: PCT/EP2019/059214
§ 371 (c)(1),
(2) Date: Oct. 16, 2020

(87) PCT Pub. No.: WO2019/206652
PCT Pub. Date: Oct. 31, 2019

(65) Prior Publication Data

US 2021/0167549 A1 Jun. 3, 2021

(30) Foreign Application Priority Data

Apr. 23, 2018 (DE) ..... 202018102260.1

(51) Int. Cl.
*H01R 13/62* (2006.01)
*H01R 13/627* (2006.01)
*H01R 24/86* (2011.01)

(52) U.S. Cl.
CPC ..... *H01R 13/6272* (2013.01); *H01R 24/86* (2013.01)

(58) Field of Classification Search
CPC ..... H01R 13/6272; H01R 24/86
(Continued)

(56) References Cited

U.S. PATENT DOCUMENTS 3,152,815 A * 10/1964 Barragato ..... H01R 13/633 285/1
3,563,318 A * 2/1971 Eberhardt ..... A01B 35/225 172/750

(Continued)

FOREIGN PATENT DOCUMENTS

CN 205882284 1/2017
CN 206850124 1/2018

(Continued)

OTHER PUBLICATIONS

Neutrik Product Guide 2015/2015, 26 pages.
Prior art figure—Plug-in connection, Jan. 2018 (admitted prior art).

*Primary Examiner* — Alexander Gilman
(74) *Attorney, Agent, or Firm* — Volpe Koenig

(57) ABSTRACT

A plug connector part of a plug-in connection, the plug connector part having a plug connector part housing, one or more electrical and/or optical contacts, at least one locking spring, and, in the plug connector part housing, at least one receiving space for insertion of an insertion part of a mating plug connector part of the plug-in connection. When the mating plug part is in the inserted state, completely inserted into the receiving space in an insertion direction, the mating plug connector part is locked by a longitudinal stop surface of the locking spring in a locking position of the locking spring to prevent the insertion part from being pulled out of the receiving. In addition to the longitudinal stop surface, the locking spring has at least one transverse stop surface for pressing the insertion part against the plug part housing in a direction transverse to the insertion direction.

12 Claims, 3 Drawing Sheets

(58) Field of Classification Search
USPC ..... 439/692
See application file for complete search history.

(56) References Cited

U.S. PATENT DOCUMENTS

| | | | | |
|---|---|---|---|---|
| 3,837,690 | A * | 9/1974 | Fraser, Jr | F16L 37/098 285/319 |
| 4,035,005 | A * | 7/1977 | DeVincent | F16L 37/0985 285/319 |
| 4,671,540 | A * | 6/1987 | Medvick | F16L 37/133 137/614.03 |
| 5,135,029 | A * | 8/1992 | Anderson | F16L 35/00 137/614.04 |
| 5,435,744 | A * | 7/1995 | Derstine | H01R 13/5045 439/352 |
| 5,695,221 | A * | 12/1997 | Sunderhaus | F16L 55/1015 251/149.7 |
| 5,823,813 | A * | 10/1998 | Dye | H01R 13/62905 439/347 |
| 6,825,417 | B2 * | 11/2004 | Ball | F16C 1/265 174/74 R |
| 7,175,464 | B2 | 2/2007 | Ferderer et al. | |
| 7,189,113 | B2 | 3/2007 | Sattele et al. | |
| 7,794,288 | B2 * | 9/2010 | Shindo | H01R 13/6277 439/680 |
| 7,857,643 | B2 * | 12/2010 | Dobler | H01R 27/00 439/172 |
| 7,862,090 | B1 * | 1/2011 | Foreman | F16L 37/008 285/347 |
| 10,135,189 | B2 * | 11/2018 | Holub | H01R 13/6271 |
| 2008/0268692 | A1 * | 10/2008 | Dobler | H01R 13/6275 439/346 |
| 2018/0205179 | A1 * | 7/2018 | Zhou | H01R 13/6581 |

FOREIGN PATENT DOCUMENTS

| | | |
|---|---|---|
| DE | 2353004 | 5/1974 |
| DE | 19958695 | 6/2001 |
| DE | 102004054022 | 6/2006 |
| DE | 102005025769 | 9/2006 |
| DE | 102006001630 | 7/2017 |
| EP | 2978079 | 1/2016 |
| WO | 2014075751 | 5/2014 |

* cited by examiner

PLUG PART OF A PLUG-IN CONNECTION

TECHNICAL FIELD

The present invention relates to a plug connector part of a plug connection, wherein the plug connector part has a plug connector part housing and one or more electrical and/or optical contacts and at least one locking spring and, in the plug connector part housing, at least one receiving space for plugging-in a plug-in part of a mating plug connector part of the plug connection, wherein the mating plug connector part, in the plugged-in state in which the plug-in part is plugged into the receiving space completely in a plug-in direction, can be locked by a longitudinal stop surface of the locking spring in a locking position of the locking spring to prevent the plug-in part from being pulled out of the receiving space contrary to the plug-in direction.

BACKGROUND

Plug connector parts of the said type for producing plug connections are known in various configurations in the prior art. They serve to connect electrical and/or optical cables to devices such as amplifiers, mixing consoles and the like, or to connect electrical and/or optical cables to other electrical and/or optical cables. So that the plug connection cannot be inadvertently disconnected, for example due to a pull on the cable, the plug connector part and the mating plug connector part of the respective plug connection are locked to one another by means of the generic locking spring. Only when this locking spring is brought from its locking position into an unlocked state as a result of a deliberate intervention, can the plug connection be disconnected by pulling the plug-in part of the mating plug connector part out of the receiving space of the plug connector part. The locking springs known from the prior art act to prevent the plug-in part from being pulled out of the receiving space exclusively by their longitudinal stop surface when the locking spring is in its locking position.

SUMMARY

The object of the invention is to improve a generic plug connector part such that, in the plugged-together state, the plug connector part and the mating plug connector part are connected to one another without play in order to prevent wobbling and therefore, in particular, a loose contact of these plug connections in the plugged-together and locked state.

To achieve this object, the invention provides that the locking spring, in addition to the longitudinal stop surface, has at least one transverse stop face for pressing the plug-in part against the plug connector part housing in a direction transverse, preferably orthogonal, to the plug-in direction.

By use of the transverse stop face, the locking spring, in the locking position of the locking spring, can press against the plug-in part in a direction transverse, preferably orthogonal, to the plug-in direction, so that this plug-in part is pressed without play against the plug connector part housing of the plug connector part. The desired lack of play of the plug connection consisting of the plug connector part and mating plug connector part in the plugged-together and locked state is thus achieved so that unwanted wobbling in this plug connection, and in particular loose contacts, can no longer occur. The invention can be used for purely electrical plug connections, for purely optical plug connections and also for hybrid plug connections, which have both electrical and optical contacts. In all these cases, the achieved inventive play-free position between the plug connector part and the mating plug connector part in the plugged-together state ensures reliable contacting between the electrical and/or optical contacts of the plug connector part, which can be configured in a manner known per se, and the electrical and/or optical mating contacts of the mating plug connector part, which can likewise be configured in a manner known per se.

In this case, the term "transverse" means an acute angle or a right angle or an obtuse angle, i.e. not parallel. The pressing of the plug-in part against the plug connector part housing can therefore take place at an acute or obtuse angle. However, the plug-in part is particularly preferably pressed against the plug connector part housing orthogonally to the plug-in direction by the locking spring, by use of the inventive transverse stop face thereof. For pressing directions which are transverse to the plug-in direction, these angles favorably deviate from the orthogonal angle by a maximum of 45°.

The plug-in part of the mating plug connector part has, in preferred configurations, an arresting notch in which the locking spring engages by its longitudinal stop surface in the locking position, in order to thereby prevent the plug-in part from being pulled out of the receiving space contrary to the plug-in direction. In this case, the arresting notch can, in this case, be designed as a type of blind hole, i.e. not continuously, but also as a continuous hole or, in other words, a window in the plug-in part. The invention also particularly preferably relates to plug connections having an inventive plug-connector part and a mating plug connector part, wherein the plug-in part of the mating plug connector part has an arresting notch for the engagement of the locking spring, wherein the arresting notch is designed as a continuous hole in the plug-in part, preferably in a wall of the plug-in part.

It is preferably provided that the locking spring, in addition to the longitudinal stop surface and to the transverse stop face, has at least one sloping face for the automatic deflection of the locking spring when the plug-in part is plugged into the receiving space. In this case, the sloping face is favorably configured such that the plug-in part necessarily comes into contact with the sloping face when it is inserted into the receiving space in the plug-in direction, so that the locking spring is deflected itself, i.e. automatically, due to the plug-in part sliding along the sloping face of the locking spring. This has the advantage that the locking spring does not have to be actuated separately, manually or otherwise, during the plugging-together of the plug connection.

To then enable the disconnection of the plug connection by pulling the plug-in part out of the receiving space, a separately present actuating element must be deliberately, preferably manually, actuated in preferred configurations. To this end, it is favorably provided that the plug connector part has an actuating element, movably mounted on the plug connector part housing and, preferably manually, actuable, for deflecting the locking spring out of the locking position. The actuating element can preferably be designed as a slider, although this is not compulsory. It would essentially also be conceivable to design the actuating element as a pivotable lever or as a combination of a slider and a pivotable lever. It is particularly preferably provided that the locking spring is deflected out of the locking position when the actuating element is manually actuated, preferably displaced, in the plug-in direction. Particularly preferred variants of the invention provide that, at least in the locking position of the locking spring, the longitudinal stop surface is arranged orthogonally to the plug-in direction and/or the transverse stop face is arranged parallel to the plug-in direction and/or the sloping face is arranged at an acute angle to the plug-in direction. For the purpose of a compact construction, it can be provided that the transverse stop face and the longitudinal stop surface and preferably also the sloping face are formed in direction succession on the locking spring. It is also preferred if the transverse stop face and the longitudinal stop surface and preferably also the sloping face are formed in the said sequence, as seen in a direction contrary to the plug-in direction, on the locking spring. If a sloping face is present, it is preferably provided that the longitudinal stop surface is arranged between the sloping face and the transverse stop face. The transverse stop face is favorably designed to be elongated in the direction parallel to the plug-in direction, at least as seen in the locking position. The transverse stop face is favorably also designed to be inherently planar or level. The transverse stop face, at least as seen in the locking position, is preferably arranged closer to a center axis of the plug connector part than the longitudinal stop surface, which center axis extends parallel to the plug-in direction. The longitudinal stop surface and the sloping face can together be designed as a type of outwardly protruding tooth on the locking spring. In any case, it is favorably provided that the locking spring is resiliently pre-tensioned in the direction towards the locking position.

The locking spring can be designed as a type of leaf spring. Preferred configurations provide that the locking spring has a region which is bent in a U-shape and from which at least two spring legs of the locking spring protrude, wherein a first of the spring legs is fastened on the plug connector part housing and a second of the spring legs is resiliently pivotable relative to the first of the spring legs. The transverse stop face and the longitudinal stop surface are then favorably formed on the second of the spring legs. In preferred variants, the above-mentioned sloping face and/or an actuating face of the locking spring, on which the above-mentioned actuating element presses against the locking spring, can also be formed on the second of the spring legs, i.e. on the spring leg which is pivotable relative to the first spring leg.

The plug connector part and also the mating plug connector part can essentially be formed very differently and have different numbers of contacts and mating contacts, irrespective of whether these are electrical and/or optical contacts and mating contacts. The same naturally also applies to the forms of the plug-in part and accordingly also to the forms of the receiving space. In any case, it is generally provided that the form of the plug-in part is matched to the form of the receiving space. Particularly preferred variants provide that the receiving space is designed to be annular, at least in certain regions. The receiving space particularly preferably has the form of a circular cylindrical annulus, at least in certain regions. The form of the plug-in part is then favorably designed to be correspondingly compatible therewith.

The plug connector part with the inventive locking spring can essentially be a cable plug part, which is mounted on a cable. However, preferred configurations provide that the inventive plug connector part is a chassis socket for mounting on a housing of a device. Such a device can be, for example, a mixing console, an amplifier and the like.

BRIEF DESCRIPTION OF THE DRAWINGS

Further features and details of preferred configurations of the inventive plug connector part and the associated plug connection are explained by way of example with the aid of the following description of the figures, which show.

DETAILED DESCRIPTION

Figure 1:
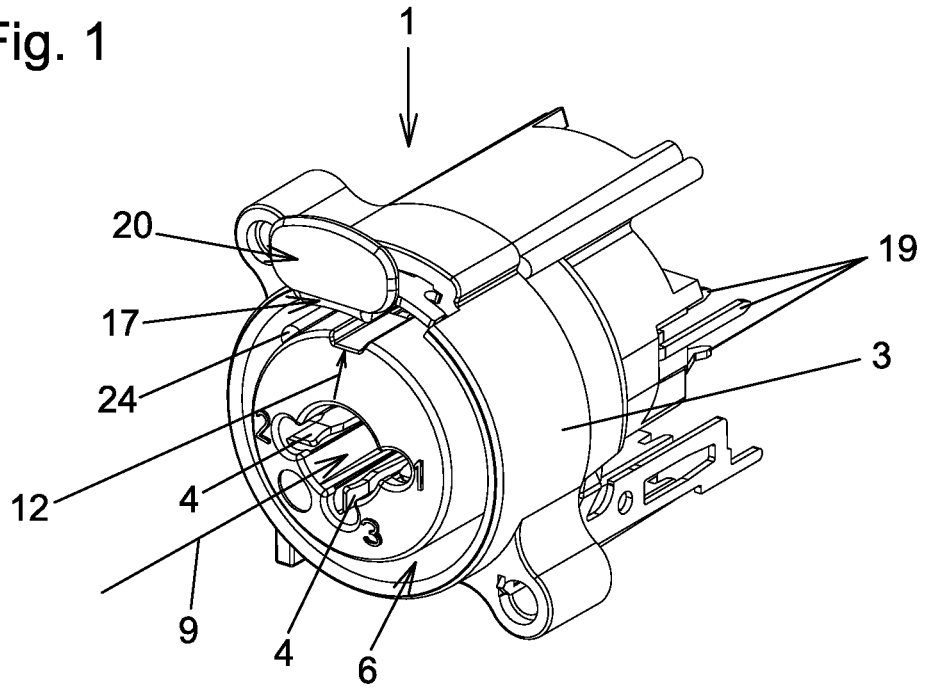
FIG. 1 an external view of an inventive plug connector part.

The plug connector part 1 illustrated in a perspective view in FIG. 1 is designed, by way of example, as a chassis socket, which is provided for mounting on a housing of a device, for example a mixing console or an amplifier. In the example shown, this is a so-called combo socket into which various mating plug connector parts 8 with different mating contacts 23 can be plugged. Specifically, in the present case according to the example of FIG. 1, the mating plug connector parts 8 can be of the type which are illustrated by way of example in FIGS. 2 and 3 and can each have three electrical mating contacts 23. These types of mating plug connector parts 8 are also commercially known as so-called XLR connectors. However, in the embodiment variant shown here, a so-called jack can also be plugged into the plug connector part 1 designed as a combo socket. This is all known per se and does not need to be explained further. It should be established in any case that, as already explained at the outset, inventive plug connector parts 1 are very different and can also be designed with a widely varying number of electrical and/or optical contacts 4. The same then also applies to the corresponding mating plug connector parts 8.

The plug connector part 1 illustrated here in any case has a plug connector part housing 3 having a receiving space 6 which is in the form of a circular cylindrical annulus, at least in certain regions. Visible on the rear of the plug connector part housing 3 are the connections 19 to which cables can be connected, as is known per se, in order to thereby connect the electrical contacts 4 of the plug connector part 1 shown here.

Moreover visible in FIG. 1 is the actuating element 17 with which the locking spring 5 can be deflected out of its locking position (which locking spring, concealed in the plug connector part housing 3, cannot be seen in FIG. 1). In the exemplary embodiment shown, the actuating element 17 is designed as a slider. It has the presser face 20. If the presser face 20 is pressed parallel to the plug-in direction 9, the actuating element 17 in the exemplary embodiment shown here is pushed a short distance into the plug part housing 3, whereby the locking spring 5 is deflected out of its locking position. In a preferred exemplary embodiment such as that illustrated here, for example, the return of the actuating element 17 after the presser face 20 is released takes place as a result of the pre-tensioning of the locking spring 5 in the direction towards the locking position. This is all shown particularly clearly in FIGS. 6 and 7, which are explained in further detail below.

Figure 2:
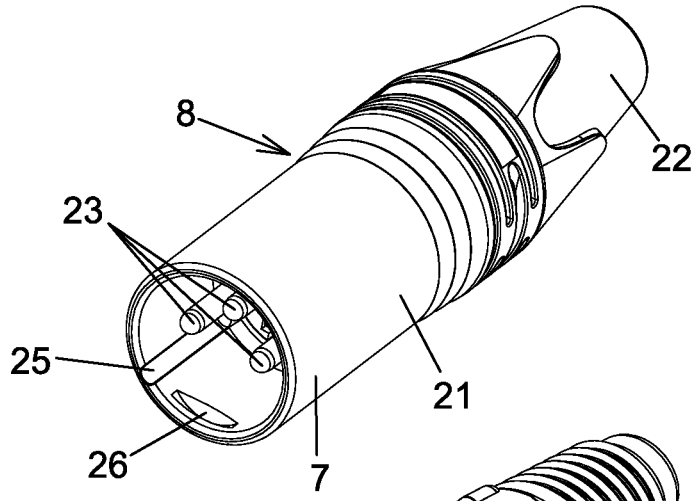
FIGS. 2 and 3 views of mating plug connector parts which are connectable thereto.
Figure 3:
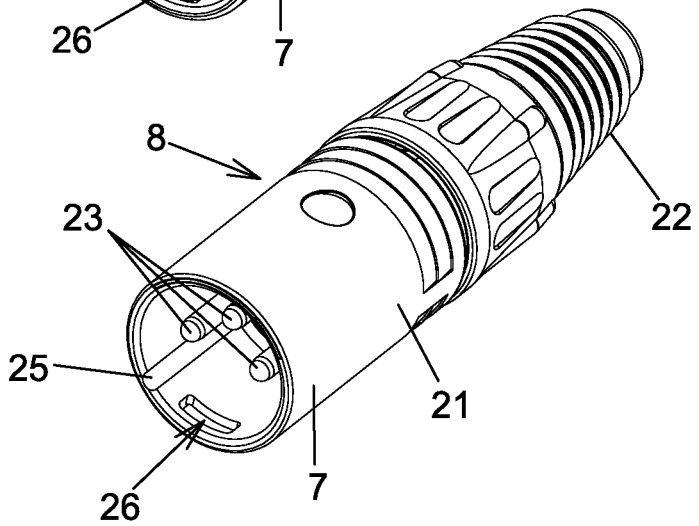

FIGS. 2 and 3 now show two different configurations of mating plug connector parts 8, which can form a plug connection 2 by being plugged into the plug connector part 1 according to FIG. 1. Common to both mating plug connector parts 8 of FIGS. 2 and 3 is that they each have a mating plug connector part housing 21 and a cable sleeve 22. The cable, which is connected to the mating plug connector part 8 in a manner known per se and is not shown here, exits the mating plug connector part 8 through the respectively illustrated cable sleeve 22 in a manner known per se. In this example, the respective mating plug connector part housing 21 has, in each case, a plug-in part 7 which is in the form of a circular cylindrical annulus, at least in certain regions, and which can be plugged into the receiving space 6 of the plug connector part housing 3 of the plug connector part 1 of FIG. 1 in the plug-in direction 9 to form the plug connection 2. When the plug-in part 7 is plugged into the receiving space 6, contacting between the contacts 4 (formed as electrical contacts 4 in the example shown here) of the plug connector part 1 and the mating contacts 23 of the mating plug connector part 8 then also occurs in a manner known per se. The difference between the two mating plug connector parts 8 of FIGS. 2 and 3, which is worth mentioning in connection with the invention, consists in the configuration of the arresting notch 26 in the respective plug-in part 7. In the variant according to FIG. 2, this arresting notch is designed as a notch in the form of a blind hole, i.e. it does penetrate the wall of the plug-in part 7 completely. In the variant according to FIG. 3, on the other hand, the latching notch 26 is a continuous opening which penetrates the wall of the plug-in part 7 completely, i.e. it forms a type of window. Irrespective of the configuration of the arresting notch 26, this is provided for the engagement of the locking spring 5, at least with its longitudinal stop surface 10, in the locking position, in order to thereby lock the plug-in part 7 against being pulled out of the receiving space 6 contrary to the plug-in direction 9. This is also explained in further detail below with the aid of FIGS. 6 and 7.

Reference should also be made here to the indexed groove 25, formed here on the plug-in part 7 in this example, and the indexed rib 24, corresponding to said indexed groove, in the receiving space 6 of the plug connector part 1. Such indexations can essentially be designed very differently. This is also known per se in the prior art. In any case, the indexations can serve so that, to prevent faulty contacting, the plug-in part 7 can only be plugged into the receiving space 6 in one position, namely the correct position, in the plug-in direction 9.

Figure 4:
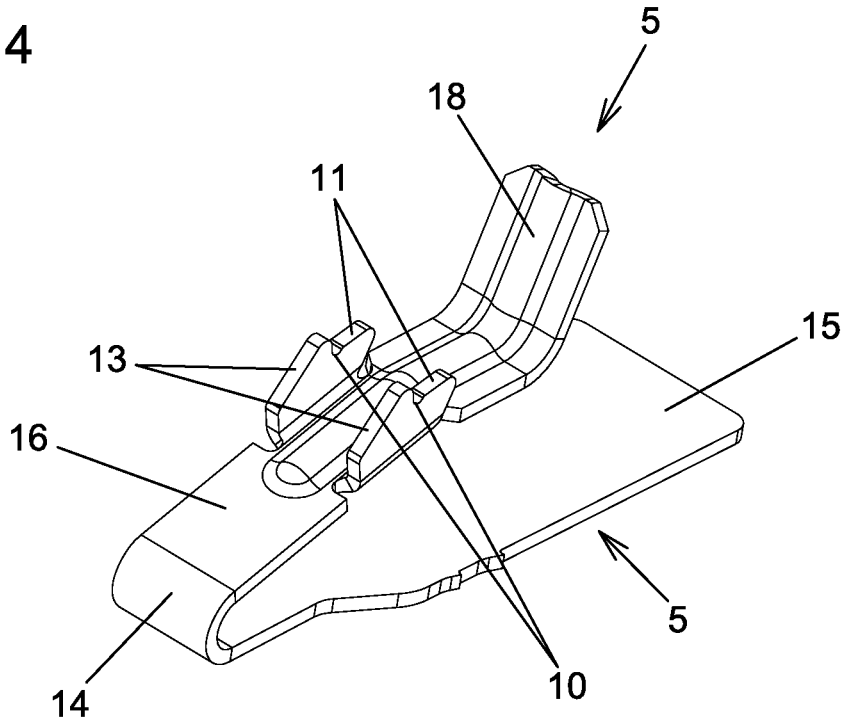
FIGS. 4 and 5 views of the locking spring of the inventive plug connector part according to FIG. 1.
Figure 5:
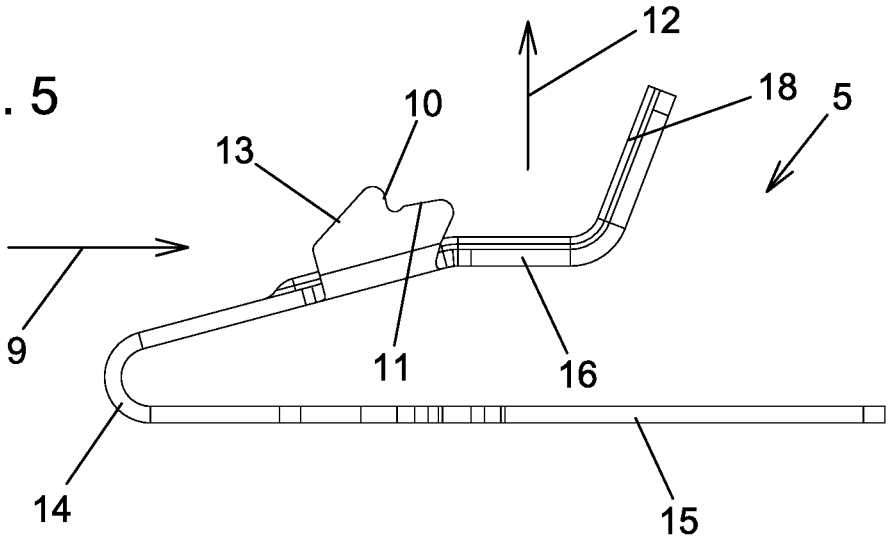

FIG. 4 and FIG. 5 now show, detached from the other components of the plug connector part 1 according to FIG. 1, the locking spring 5 thereof, which is concealed within the plug connector part housing 3 in the plugged-together state; FIG. 4 in a perspective illustration and FIG. 5 in a side view.

According to the invention, this locking spring 5 has, in addition to the longitudinal stop surface 10, at least one transverse stop face 11 for pressing the plug-in part 7 against the plug connector part housing 3 in a direction 12 transverse, preferably orthogonal, to the plug-in direction 9. In addition, the locking spring 5 also has at least one sloping face 13 for the automatic deflection of the locking spring 5 when the plug-in part 7 is plugged into the receiving space 6. In the exemplary embodiment shown here, the transverse stop faces 11 and the longitudinal stop surfaces 10 and also the sloping faces 13 are formed in direct succession on the locking spring 5. Furthermore, in this example, the transverse stop faces 11 and the longitudinal stop surfaces 10 and the sloping faces 13 are, in each case, present in pairs, as can be clearly seen in FIG. 4. Moreover, they are formed in the said sequence, contrary to the plug-in direction 9, on the locking spring 5. In this variant, the longitudinal stop surface 10 is arranged between the sloping face 13 and the transverse stop face 11. This can also be seen in FIG. 5. The transverse stop face 11 is favorably designed to be elongated in the direction parallel to the plug-in direction 9, at least as seen in the locking position according to FIG. 6, and, in this example, is also designed to be inherently planar or level here. The locking spring 5 is resiliently pre-tensioned in the direction towards the locking position. It has a region 14 which is bent in a U-shape and from which at least two spring legs 15 and 16 of the locking spring 5 protrude. The locking spring 5 is fastened on the plug connector part housing 3 by the first of the spring legs 15. The second of the spring legs 16 is resiliently pivotable relative to the first spring leg 15. The actuating face 18 of the locking spring 5 shown here is also located on the second of the spring legs 16. The actuating element 17 presses against this actuating face 18 when the presser face 20 is pressed in the plug-in direction 9, in order to thereby deflect the locking spring 5 out of its locking position.

Figure 6:
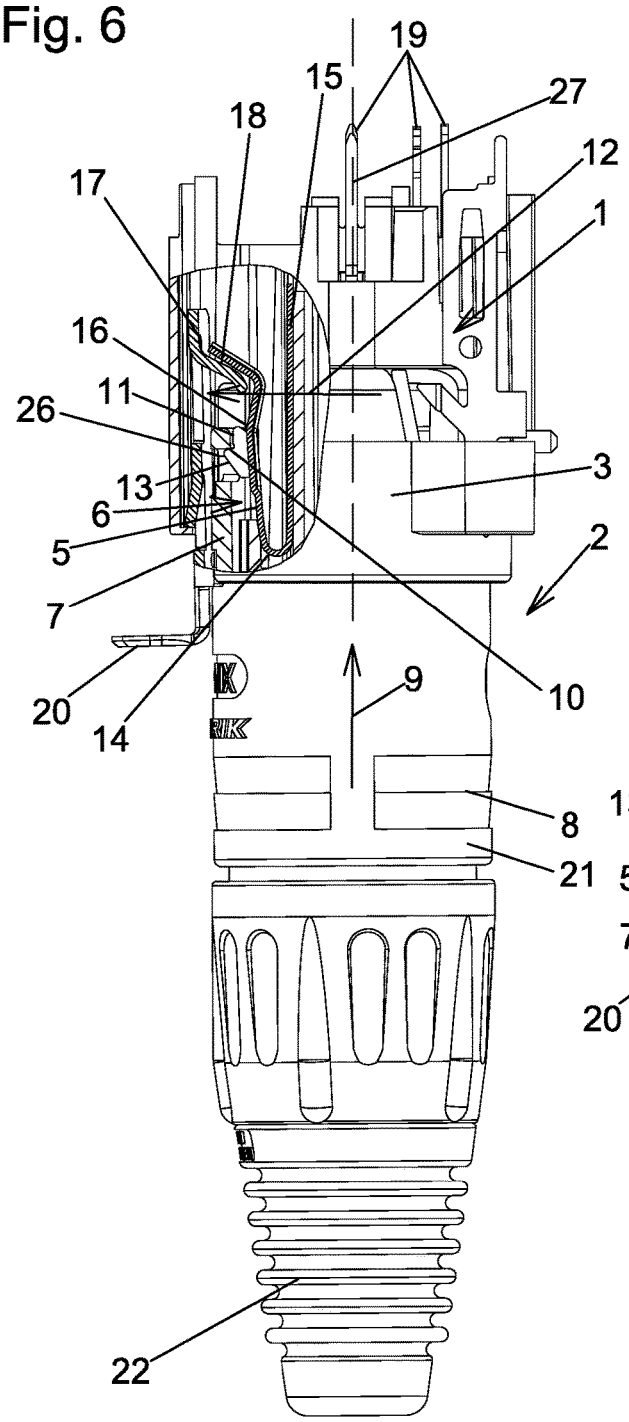
FIGS. 6 and 7 the plugged-together plug connection in an illustration which is cut away in certain regions.
Figure 7:
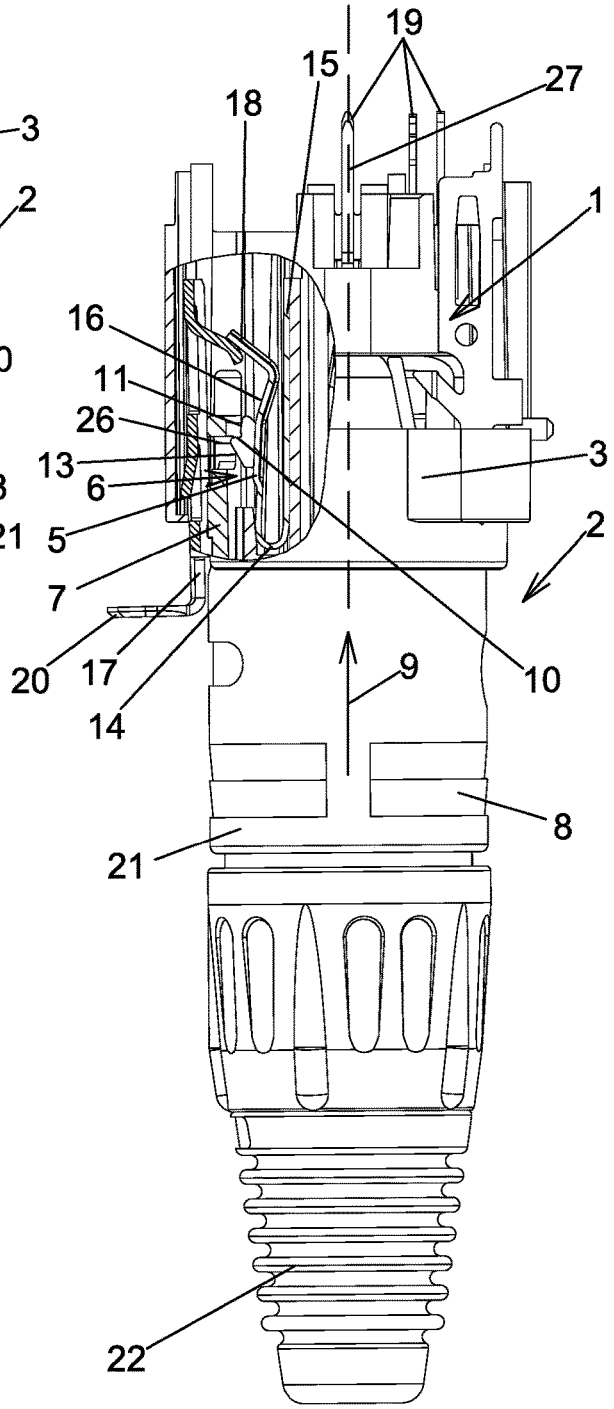

The plug connection 2 is now shown in the plugged-together state in FIGS. 6 and 7 in each case. Specifically, this relates to the connection of the plug connector part 1 of FIG. 1 to the mating plug connector part 8 of FIG. 3, i.e. the type of plug connection 2 mentioned at the outset to a mating plug connector part 8 having an arresting notch 26 designed as a continuous hole in the plug-in part 7. This is clearly visible in the partially cut-away illustrations according to FIGS. 6 and 7 based on the configurations of the latching notch 26 in the form of a continuous open window or hole. The cut-away regions illustrated in FIGS. 6 and 7 show the locking spring 5 in the interior of the plug connector part housing 3 in each case. In this case, FIG. 6 shows the locking position of the locking spring 5, in which the locking spring 5, by means of the longitudinal stop surface 10, prevents the plug-in part 7 from being pulled out of the receiving space 6 contrary to the plug-in direction 9. FIG. 7, on the other hand, shows the unlocked position in which, by pressing on the presser face 20, the actuating element 17, designed here as a slider, is pressed in the plug-in direction 9 until, as a result of its contact with the actuating face 18, it brings the locking spring 5 into the unlocked position. In this unlocked position, the longitudinal stop surfaces 10 are lifted out of the arresting notch 26 due to a corresponding pivoting of the second spring leg 16 so that, in this unlocked position, the plug-in part 7 and therefore the mating plug connector part 8 can be pulled out of the plug connector part 1 contrary to the plug-in direction 9.

In the locked position according to FIG. 6, the transverse stop faces 11 of the locking spring 5 press the plug-in part 7 against the plug connector part housing 3 in a direction transverse, here even orthogonal, to the plug-in direction 9. As an effect of this, the mating plug connector part 8 is secured without play on the plug connector part 1 so that wobbling within the plug connection 2, and, in particular, resultant loose contacts between the contacts 4 and the mating contacts 23, cannot occur.

The transverse stop faces 11, at least as seen in the locking position according to FIG. 6, are preferably arranged closer to the center axis 27 of the plug connector part 1 than the longitudinal stop surfaces 10, which center axis extends parallel to the plug-in direction 9.

KEY TO THE REFERENCE NUMERALS

1 Plug connector part
2 Plug connection
3 Plug connector part housing
4 Contact
5 Locking spring
6 Receiving space
7 Plug-in part

8 Mating plug connector part
9 Plug-in direction
10 Longitudinal stop surface
11 Transverse stop face
12 Direction
13 Sloping face
14 Region
15 First of the spring legs
16 Second of the spring legs
17 Actuating element
18 Actuating element
19 Connections
20 Presser face
21 Mating plug connector part housing
22 Cable sleeve
23 Mating contact
24 Indexed rib
25 Indexed groove
26 Arresting notch
27 Center axis

The invention claimed is:

1. A plug connector part of a plug connection, the plug connector part comprising:

a plug connector part housing;

one or more electrical and/or optical contacts;

at least one locking spring having a longitudinal stop surface;

at least one receiving space in the plug connector part housing for plugging-in a plug-in part of a mating plug connector part of the plug connection;

the mating plug connector part, in a plugged-in state in which the plug-in part is plugged into the receiving space completely in a plug-in direction, is locked by the longitudinal stop surface of the locking spring in a locking position of the locking spring to prevent the plug-in part from being pulled out of the receiving space counter to the plug-in direction; and the locking spring further comprises at least one transverse stop face configured to press the plug-in part against the plug connector part housing in a direction transverse to the plug-in direction.

2. The plug connector part as claimed in claim 1, the locking spring further comprises at least one sloping face configured for automatic deflection of the locking spring when the plug-in part is plugged into the receiving space.

3. The plug connector part as claimed in claim 1, wherein at least in the locking position of the locking spring, at least one of: the longitudinal stop surface is arranged orthogonally to the plug-in direction, the transverse stop face is arranged parallel to the plug-in direction, or the sloping face is arranged at an acute angle to the plug-in direction.

4. The plug connector part as claimed in claim 2, wherein the transverse stop face, the longitudinal stop surface, and the sloping face are formed in direct succession, counter to the plug-in direction, on the locking spring.

5. The plug connector part as claimed in claim 1, wherein the locking spring is resiliently pre-tensioned in the direction towards the locking position.

6. The plug connector part as claimed in claim 1, wherein the locking spring has a region which is bent in a U-shape and from which at least first and second spring legs of the locking spring protrude, wherein the first spring leg is fastened on the plug connector part housing and the second spring leg is resiliently pivotable relative to the first spring leg.

7. The plug connector part as claimed in claim 6, further comprising an actuating element, movably mounted on the plug connector part housing that is actuable, for deflecting the locking spring out of the locking position.

8. The plug connector part as claimed in claim 7, the transverse stop face, the longitudinal stop surface, and an actuating face of the locking spring, on which the actuating element presses against the locking spring, are formed on the second spring leg.

9. The plug connector part as claimed in claim 1, wherein the receiving space comprises an annular opening, at least in certain regions.

10. The plug connector part as claimed in claim 1, wherein the plug connector part is a chassis socket for mounting on a housing of a device.

11. The plug connector part as claimed in claim 1, further comprising an actuating element, movably mounted on the plug connector part housing that is actuable, for deflecting the locking spring out of the locking position.

12. The plug connector part of claim 11, wherein the actuating element is formed as a slider.

* * * * *